US008186809B2

(12) United States Patent
Touge

(10) Patent No.: US 8,186,809 B2
(45) Date of Patent: May 29, 2012

(54) INK JET RECORDING HEAD HAVING SUBSTRATE WITH ELECTRODES CONNECTED TO ELECTROTHERMAL TRANSDUCERS AND ELECTRODES NOT CONNECTED TO THE TRANSDUCERS

(75) Inventor: Yoshiyuki Touge, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 90 days.

(21) Appl. No.: 11/671,604

(22) Filed: Feb. 6, 2007

(65) Prior Publication Data

US 2007/0126798 A1 Jun. 7, 2007

Related U.S. Application Data

(62) Division of application No. 10/998,904, filed on Nov. 30, 2004, now Pat. No. 7,192,123.

(30) Foreign Application Priority Data

Dec. 3, 2003 (JP) ..... 2003-404514

(51) Int. Cl.
*B41J 2/05* (2006.01)
*B41J 2/14* (2006.01)
*B41J 2/16* (2006.01)

(52) U.S. Cl. ..... 347/58; 347/50

(58) Field of Classification Search ..... 29/890.1; 347/17, 18, 20, 50, 57–59, 84–87
See application file for complete search history.

(56) References Cited

U.S. PATENT DOCUMENTS 5,367,324 A * 11/1994 Abe et al. ..... 347/43
5,847,356 A * 12/1998 Santhanam ..... 219/121.64
5,870,120 A * 2/1999 Terai ..... 347/56
6,007,176 A * 12/1999 Askren et al. ..... 347/18
6,190,006 B1 2/2001 Kurashima et al.
6,619,786 B2 * 9/2003 Cobb et al. ..... 347/50
2003/0067510 A1 * 4/2003 Isono ..... 347/68
2003/0145463 A1 * 8/2003 Nishikawa et al. ..... 29/890.1
2003/0218658 A1 * 11/2003 Ito ..... 347/68
2005/0185028 A1 * 8/2005 Sakaida et al. ..... 347/68

FOREIGN PATENT DOCUMENTS

| | | |
|---|---|---|
| JP | 4-261097 | 9/1992 |
| JP | 6-90069 | 3/1994 |
| JP | 10-085965 | 4/1998 |
| JP | 10-119292 | 5/1998 |
| JP | 11-147311 | 6/1999 |
| JP | 11-233904 | 8/1999 |
| JP | 11-300956 | 11/1999 |
| JP | 2000-187273 | 7/2000 |
| JP | 2001-246749 | 9/2001 |

* cited by examiner

*Primary Examiner* — David Angwin
(74) *Attorney, Agent, or Firm* — Fitzpatrick, Cella, Harper & Scinto

(57) ABSTRACT

A liquid discharging head improved in heat dissipation property includes a rectangular recording element substrate having electrothermal transducers generating thermal energy for discharging liquid, first electrodes for supplying electrical signals to the electrothermal transducers, and second electrodes not used for supplying electrical signals to the electrothermal transducers, and a wiring sheet having an opening through which the recording element substrate is exposed, the wiring sheet being provided with a first wiring pattern electrically connected to the first electrodes and a second wiring pattern connected to the second electrodes. A plurality of the first electrodes are formed along a first side of the recording element substrate having a predetermined length and a plurality of the second electrodes are formed along a second side of the recording element substrate, the second side being longer than the first side and extending in a direction transverse to the first side.

2 Claims, 11 Drawing Sheets

INK JET RECORDING HEAD HAVING SUBSTRATE WITH ELECTRODES CONNECTED TO ELECTROTHERMAL TRANSDUCERS AND ELECTRODES NOT CONNECTED TO THE TRANSDUCERS

This is a divisional application of application Ser. No. 10/998,904, filed Nov. 30, 2004, now allowed.

BACKGROUND OF THE INVENTION

1. Field of the Invention

The present invention relates to a structure of an ink jet recording head, and in particular, it relates to heat dissipation of a substrate in which an energy generating portion for discharging an ink is arranged.

2. Related Background Art

In front of recording means (ink jet recording head) of an ink jet recording apparatus, there are formed discharge ports (usually plural pieces) having a size of about several tens μm for discharging an ink droplet. Based on a discharge signal processed inside a recording apparatus based on a recording data transferred from a host device, the ink droplet is discharged from the discharge port, and an image (including characters and symbols) is recorded on a recorded material.

For a representative ink jet recording head, there is a system using an electrothermal conversion element. This system provides the electrothermal conversion element in an ink path in the vicinity of the ink discharge port in the recording head, and by utilizing thermal energy generated by applying an electrical pulse to this element according to a recording signal, bubbles are allowed to be generated in the ink, and by the pressure of the bubbles, the ink is discharged from the discharge port.

As a structure of the ink jet recording head, there is disclosed a structure in Japanese Patent Application Laid-Open No. H10-119292, and in that Publication, there is disclosed a structure having an excellent heat dissipation property by insert-molding an aluminum system alloy material into a resin support member. Further, in U.S. Pat. No. 6,007,176, there is disclosed a structure, which has increased the heat dissipation property by mounting a recording element substrate arranged with the electrothermal conversion element on a radiating fin. Moreover, in Japanese Patent Application Laid-Open No. 2000-187273, there is disclosed an invention, in which a fixing reinforcement of a flexible wiring sheet to the substrate is performed by bonding a dummy lead electrode, which does not perform giving and receiving a recording signal, and a substrate side electrode, in a structure where the lead electrode provided in the flexible wiring sheet and the substrate side electrode provided in the substrate arranged with the recording element are bonded.

In the structure of a conventional ink jet recording head, though heat dissipation from the recording element substrate is mainly performed through a rear surface, which is an adhesion surface of the substrate, through a binding material layer, thermal conductivity of the binding agent of the substrate is usually far inferior to that of a metal.

Further, in the structure disclosed in the above described Japanese Patent Application Laid-Open No. 2000-187273, though heat dissipation through the dummy lead electrode is performed, the lead electrode is provided for the purpose of the fixing reinforcement of the flexible wiring sheet to the substrate, and therefore, the amount of heat generation thereof cannot be said to be sufficient.

In the meantime, in recent year, the ink jet recording head has increased its amount of heat dissipation accompanied with its speeding up and high densification, and for increase of this amount of heat generation, the ink jet recording head is expected to further improve the heat dissipation property.

SUMMARY OF THE INVENTION

The present invention has been made in view of the unsolved problems held by the prior art, and an object of the invention is to provide an ink jet recording head and a manufacturing method thereof in which heat dissipation property has been further improved.

Another object of the present invention is to provide an ink jet recording head comprising a substrate arranged with a plurality of discharging energy generating portions for discharging ink droplets, which comprises: a plurality of electrical wiring electrodes provided for supplying electrical signals to the plurality of discharging energy generating portions provided in the substrate; a plurality of auxiliary electrodes not used for supplying the electrical signals to the plurality of discharging energy generating portions provided in the substrate; a first sheet having a wiring pattern electrically conducted to an electrical wiring electrode terminal to be connected to the plurality of electrical wiring electrodes; and a second sheet having a wiring pattern electrically conducted to a auxiliary electrode terminal to be connected to the plurality of auxiliary electrodes, the ink jet recording head comprising a wiring sheet in which the first sheet and the second sheet are arranged so as to be superposed on each other. By the ink jet recording head constituted in this way, the heat from the substrate provided with the discharging energy generating portion is transferred to the first sheet and the second sheet arranged so as to be superposed on each other through the electrical wiring electrode and the auxiliary electrode provided in the substrate, so that the ink jet recording head further improved in the heat dissipation property can be provided. Further, by more effectively releasing from the recording element substrate the heat generated by recording operation by such an ink jet recording head, the ink jet recording head capable of steady operation can be provided.

DESCRIPTION OF THE PREFERRED EMBODIMENTS

Embodiments of an ink jet recording head according to the present invention will be described below with reference to the drawings.

First Embodiment

Figure 1:
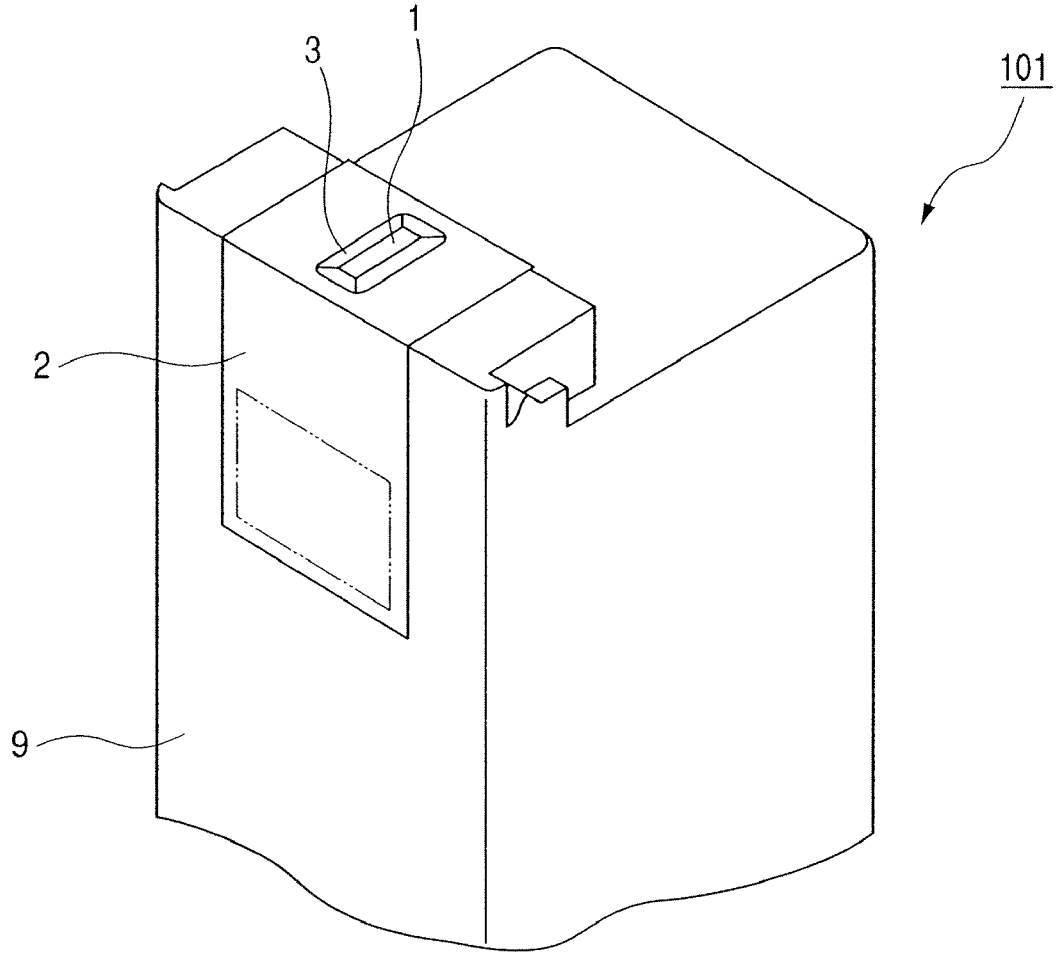
FIG. 1 is a schematic oblique view of an ink jet recording head as a first embodiment according to the present invention.

FIG. 1 is a view showing an ink jet recording head 101 as a first embodiment of the present invention. A recording element substrate 1 is fixed to a container 9, which is a support member, through an adhesive, and is electrically connected to a flexible wiring substrate 2 as a wiring member. The connecting portion of the recording element substrate 1 and the flexible wiring substrate 2 is covered and protected by a sealing compound 3. The flexible wiring substrate 2, similarly to the recording element substrate 1, is fixed also to the container 9, which is the support member, through the adhesive.

Figure 2A:
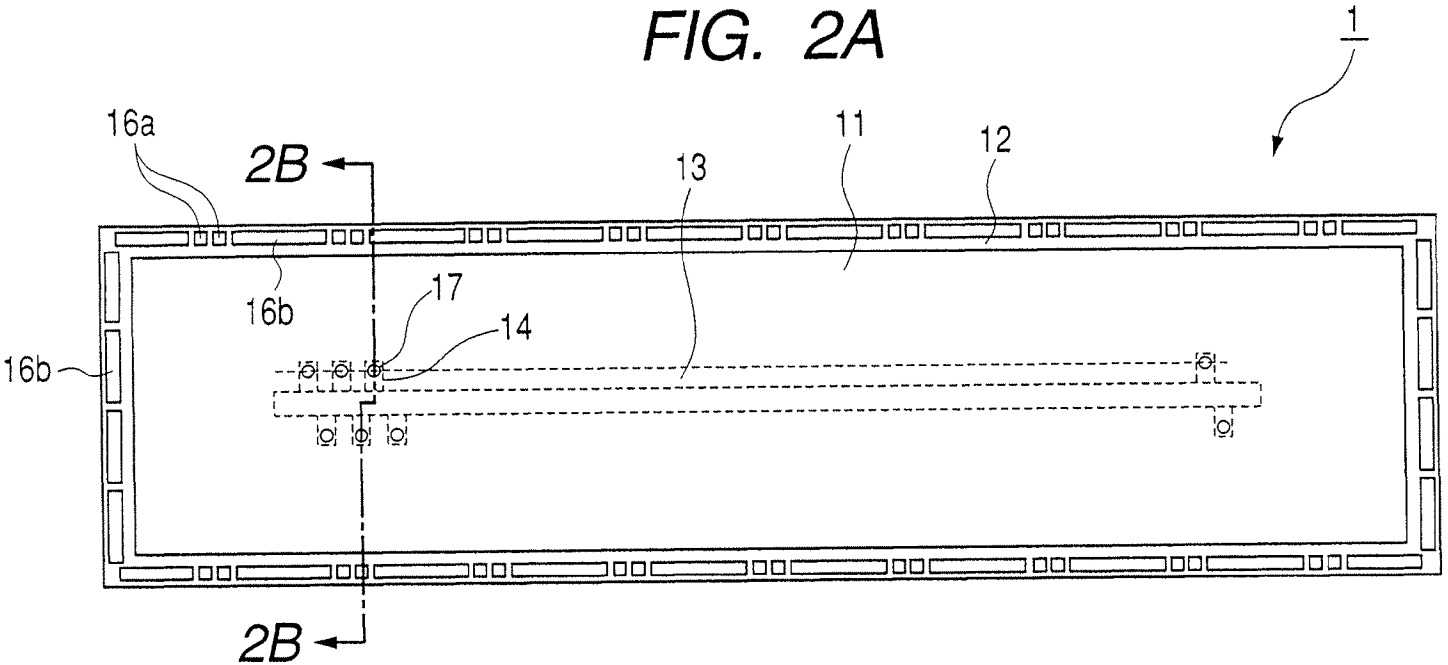
FIGS. 2A and 2B are schematic explanatory drawings of a recording element of the first embodiment.
Figure 2B:
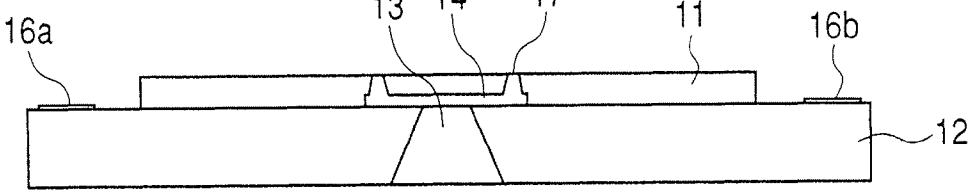

FIGS. 2A and 2B are a top view and a sectional view showing a schematic structure of the recording element substrate 1, and FIG. 2B is a magnified sectional view cut along a line 2B-2B of FIG. 2A.

The recording element substrate 1 makes a two-layer structure of an orifice plate 11 and a substrate 12, and forms a plurality of ink paths 14. In the orifice plate 11, there are provided ink discharge ports 17 corresponding to each ink path 14, and these ink discharge ports 17 have 300 dpi per one column, and two columns thereof are provided. The substrate 12 has a size of 4.8 mm in width×17 mm in length×0.625 mm in thickness, and in the center portion thereof, there are provided ink supply ports 13 for supplying ink to each ink path 14 and electrothermal conversion elements (not shown) as energy generating portions corresponding to each ink path 14 as regions for generating energy for discharging ink, and moreover, a plurality of electrodes 16*a* and a plurality of electrodes 16*b* on the outer periphery thereof. The plurality of electrodes 16*a* which are electrical wiring electrodes are square-shaped and for inputting an electrical signal such as recording signals and the like from the ink jet recording apparatus main body side, and the plurality of electrodes 16*b* which are auxiliary electrodes are rectangle-shaped and connected to a base layer of the substrate 12, but not for driving the electrothermal conversion elements upon receipt of the recording signals. These electrodes 16*a* and 16*b* are formed by using a plating patterning technique.

While the recording element substrate 1, as illustrated, is made rectangle-shaped, in the opposing short sides thereof, the electrodes 16*b* alone are arranged, and in the long sides thereof, two electrodes 16*a* are arranged regularly and moreover at equal intervals in such a way as to be arranged between electrodes 16*b*.

Figure 3A:
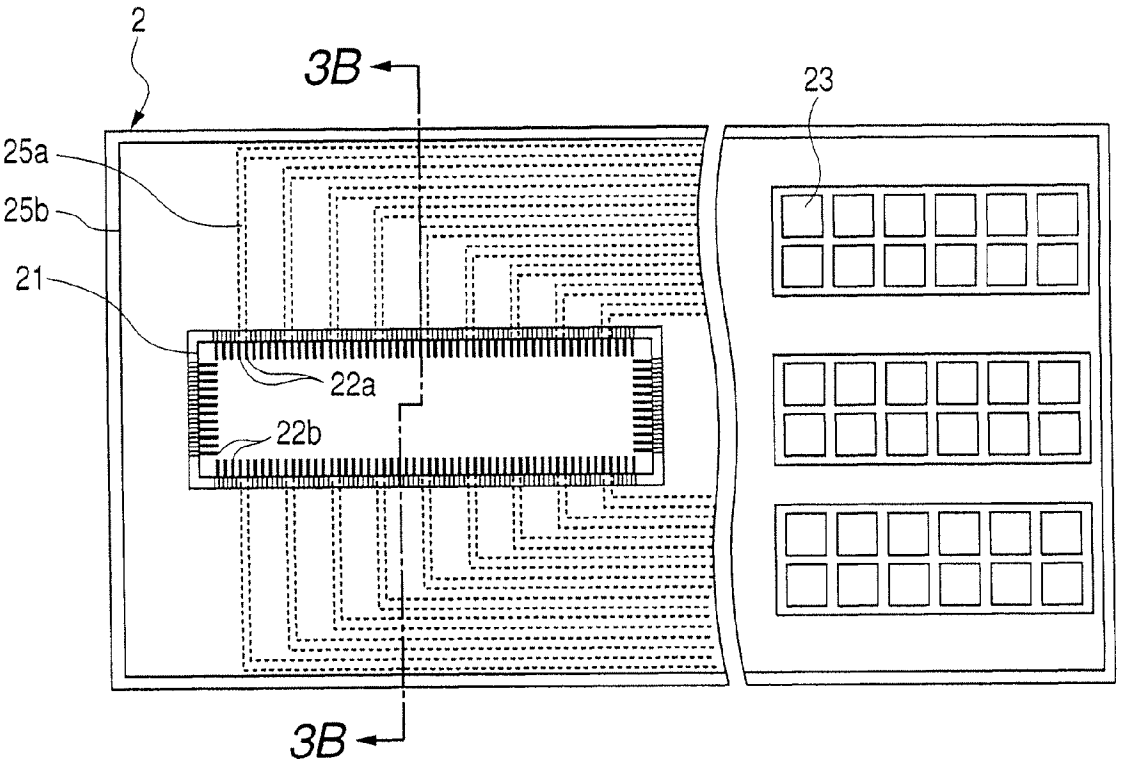
FIGS. 3A and 3B are schematic explanatory drawings of a flexible wiring substrate of the first embodiment.
Figure 3B:
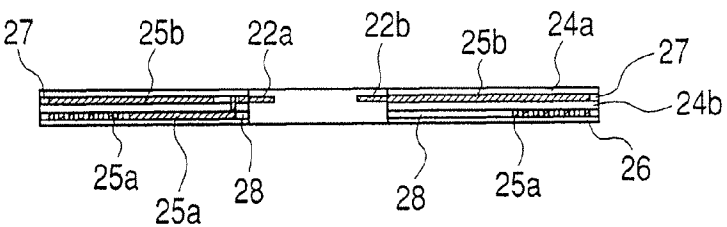

FIGS. 3A and 3B are a top view and a sectional view showing a schematic structure of a flexible wiring substrate 2, and FIG. 3B is a sectional view cut along a line 3B-3B of FIG. 3A.

An opening 21 is provided to be able to see the recording element substrate 1 when the flexible wiring substrate 2 is attached to the container 9 together with the recording element substrate 1 (see FIG. 1), and in the inner periphery of the opening 21, there are projected a plurality of terminals (electrical wiring electrode terminals) 22*a* coupled with a plurality of electrodes 16*a* provided in the recording element substrate 1, and a plurality of terminals (auxiliary electrode terminals) 22*b* coupled with a plurality of electrodes 16*b* provided similarly in the recording element substrate 1. A plurality of electrode pads 23 are provided so as to individually correspond to each of the plurality of terminals 22*a*, and receive the electrical signals from the ink jet recording apparatus main body, and play a role of transferring them to the recording element substrate 1. The terminal 22*a* is 100 μm in width, and the terminal 22*b* is 200 μm in width, and both of the terminals are 1 mm in length.

As shown in FIG. 3B, the flexible wiring substrate 2 is constituted by comprising two wiring sheets which are arranged so as to be superposed on each other, and between a base material 24*a* and a base material 24*b*, there is formed a space for providing a second wiring sheet 25*b*, and moreover, in that space, there are provided a plurality of terminals 22*b* connected to the wiring sheet 25*b* and also a connecting portion neighborhood with the terminal 22*a* and the wiring sheet 25*a* used for executing the recording. An adhesive 27 for adhering the base material 24*a* and the base material 24*b* fills up that space.

Further, between the base material 24*b* and a protective material 26, there is formed a space for providing a first wiring sheet 25*a*, and that space is filled up by an adhesive 28 for adhering the base material 24*b* and the protective material 26. The base material 24*a* and the base material 24*b* are made of polyimide resin, and the thickness thereof is 25 μm and 50 μm, respectively. The above described terminals and the wiring patterns are made of copper foil, and the thickness thereof is 70 μm in the case of the second wiring sheet 25*b*, and 35 μm in the case of the first wiring sheet 25*a*, respectively. The exposed portions of the surfaces of a plurality of electrode terminals 22*a* and 22*b* as well as a plurality of electrode pads 23 are subjected to gold plating. Here, though not illustrated, the wiring sheet 25*b* is electrically connected to a power source GND (ground) line from among the wiring patterns formed in the wiring sheet 25*a* inside the flexible substrate 2.

Figure 4:
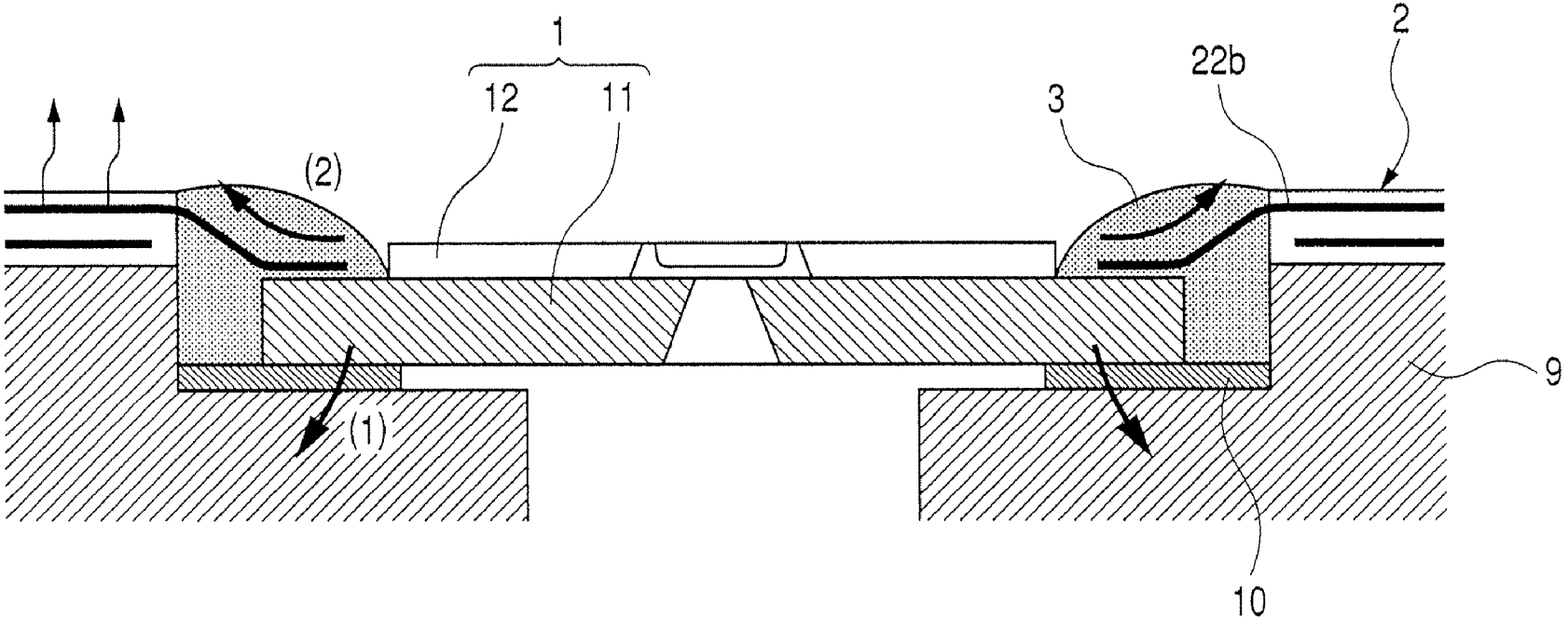
FIG. 4 is a schematic sectional view of the first embodiment.

FIG. 4 is a sectional view schematically showing a connecting state of the recording element substrate 1 and the flexible wiring substrate 2. The recording element substrate 1 is connected to the container 9 by an adhesive 10 of epoxy resin. Here, a heat dissipation mechanism in the present embodiment will be described.

First, a path (1) in which heat travels from the recording element substrate 1 to the container 9 through the adhesive 10 is considered. The thickness of the adhesive 10 is 0.2 mm, and an adhering area of the rear surface of the recording element substrate 1 is approximately 32 $mm^2$, and a heat conductivity of epoxy resin is approximately 0.2 W/mK, and therefore, the heat conductivity of the path passing from the recording element substrate 1 to the container 9 through the adhesive 10 is 0.032 W/K.

Next, a path (2) in which heat travels to the flexible wiring substrate 2 through the terminal 22*b* is considered. A sectional area of the electrode terminal 22*b* is 0.2 mm×0.07 mm=0.014 $mm^2$, and a distance from a contact point with an electrode 16*b* of the recording element substrate 1 to the wiring sheet 25*a* of the flexible wiring substrate 2 is approximately 1 mm, and the terminal 22*b* is available 100 pieces in total. Since the heat conductivity of copper is approximately 400 W/mK, the heat conductivity in this path becomes 0.56 W/K, and is 17.5 times that of the path (1).

The heat, which travels through the path (1), has to travel through the resin member container 9 having a heat conductivity of less than 1 W/mK, while the heat, which travels through the path (2), travels through the wiring pattern formed in the copper wiring sheet 25*b* having a heat conductivity of 400 W/mK. Hence, in the case of the path (2), the heat immediately travels across the entire surface of the flexible wiring substrate 2, and moreover, it is effectively dissipated into the atmosphere (ambient air) through the base material 24*a*. Hence, with regard to the wiring sheet 25*b*, it is preferable that a wiring is formed across the entirety of that surface (the entire surface is made into a conductive region).

With regard to other paths, though there are those in which heat travels through an adhesive 3, since the heat traveling through these paths is extremely small in value comparing to the heat traveling through the path (1) and the path (2), it will be appreciated that there is no need to describe them here. Further, since there is also a path available in which heat travels to the flexible wiring substrate 2 through the electrode terminal 22*a*, an actual amount of heat dissipation from the flexible wiring substrate 2 becomes a value higher than the above described estimation. However, as shown in FIG. 3A, the conductive region (wiring pattern) in the wiring sheet 25*a* is small, comparing to the wiring sheet 25*b*, and when the wiring is formed across the entire surface of the wiring sheet 25*b*, the conductive region of the wiring sheet 25*b* becomes by far large, and the heat traveling through the path (2) becomes dominant.

In the present embodiment, though a plurality of electrodes 16*b* are made rectangular, and are connected to a plurality of terminals 22*b*, even square shaped electrodes corresponding to each terminal 22*b* perform the same operation. Although, in the long sides thereof, two electrodes 16*a* are arranged regularly and moreover at equal intervals in such a way as to be arranged between electrodes 16*b*, it is not always necessarily to arrange two electrodes 16*a* between electrodes 16*b*, and moreover, the same operation is available even when the electrodes 16*a* are not arranged at equal intervals.

Second Embodiment

Next, a second embodiment of the present invention will be described.

Figure 5A:
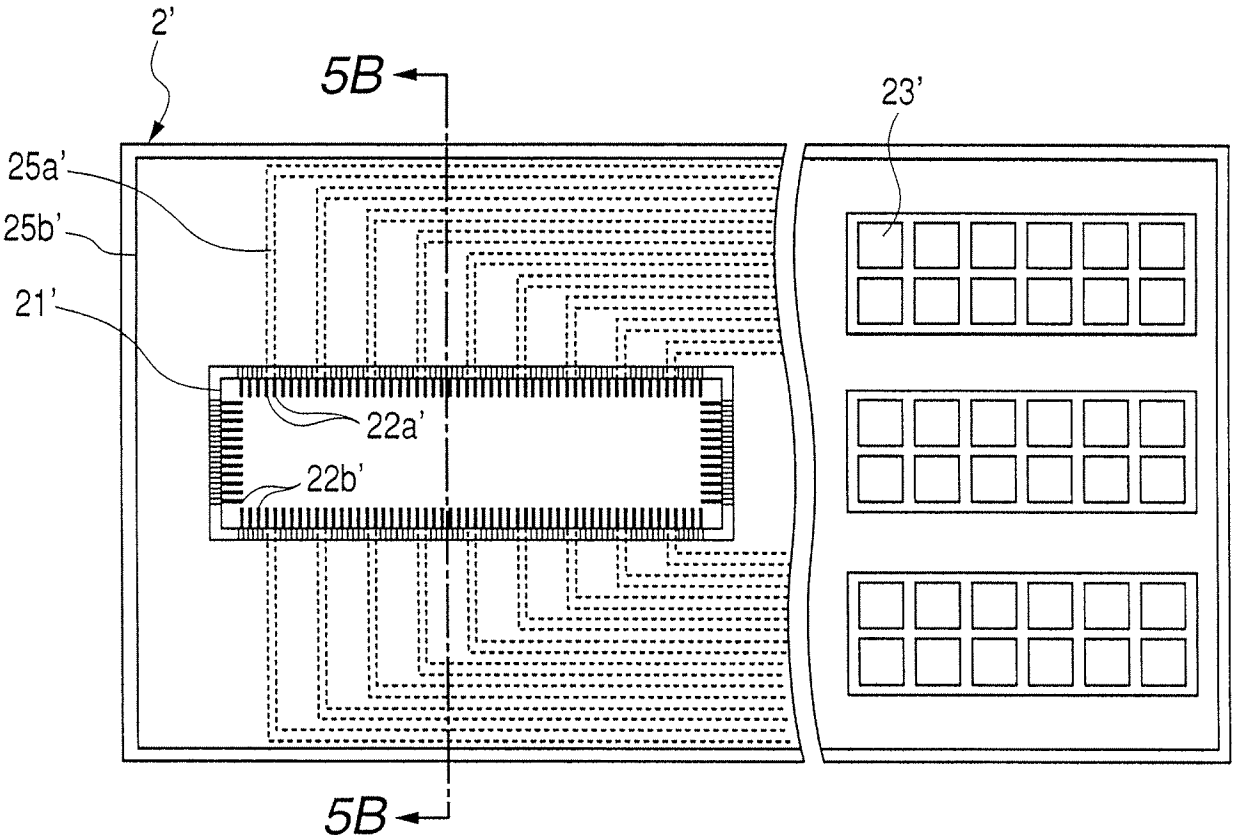
FIGS. 5A and 5B are schematic explanatory drawings of the flexible wiring substrate as a second embodiment according to the present invention.
Figure 5B:
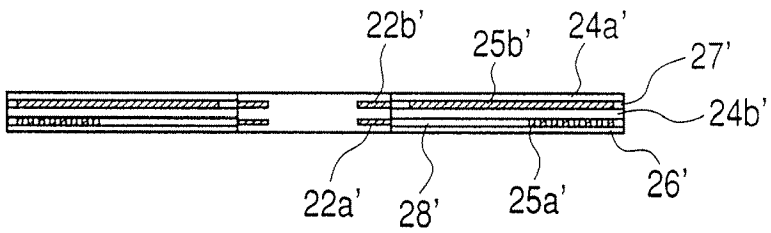

The present embodiment is the same as the embodiment of the ink jet recording head 101 shown in FIG. 1, and the structure alone of a flexible wiring substrate is different. FIGS. 5A and 5B are a top view and a sectional view showing a schematic structure of a flexible wiring substrate 2' in the present embodiment, and FIG. 5B is a sectional view cut along a line 5B-5B of FIG. 5A.

An opening 21 is provided to be able to see the recording element substrate 1 when the flexible wiring substrate 2' is attached to the container 9 together with the recording element substrate 1 (see FIG. 1), and in the inner periphery of the opening 21', there are projected a plurality of terminals 22*a'* coupled with a plurality of electrodes 16*a* which are provided in the recording element substrate 1 and involved with the supply of electrical signals such as recording signals, and a plurality of terminals 22*b'* coupled with a plurality of electrodes 16*b* which are provided in the recording element substrate 1 but not involved with the supply of electrical signals. A plurality of electrode pads 23' correspond individually to a plurality of terminals 22*a'*, and play a role of receiving the electrical signals from the ink jet recording apparatus main body, and transferring them to the recording element substrate 1. The terminal 22*a'* is 100 μm in width, and the terminal 22*b'* is 200 μm in width, and both of the terminals are 1 mm in length.

As shown in FIG. 5B, the flexible wiring substrate 2' is constituted by comprising two wiring sheets which are arranged so as to be superposed on each other, and between a base material 24*a'* and a base material 24*b'*, there is formed a space for providing a second wiring sheet 25*b'*, and moreover, in that space, there are provided a plurality of terminals 22*b'* connected to the wiring sheet 25*b'*. An adhesive 27' for adhering the base material 24*a'* and the base material 24*b'* fills up that space. Further, between the base material 24*b'* and a protective material 26', there is formed a space for providing a first wiring sheet 25*a'*, and moreover, that space is provided with a plurality of terminals 22*a'* connected to the wiring sheet 25*a'*. The adhesive 28' adhering the base material 24*b'* and the protective material 26' fills up that space. The base material 24*a'* and the base material 24*b'* are made of polyimide resin, and the thickness thereof is 25 μm and 50 μm, respectively. The above described terminals, the wiring patterns of the wiring sheets, and the electrode pads are made of copper foil, and the thickness thereof is 70 μm in the case of a first layer, and 35 μm in the case of a second layer, respectively. The exposed portions of the surfaces of a plurality of electrode terminals 22*a* and 22*b* as well as a plurality of electrode pads 23 are subjected to gold plating.

Figure 6:
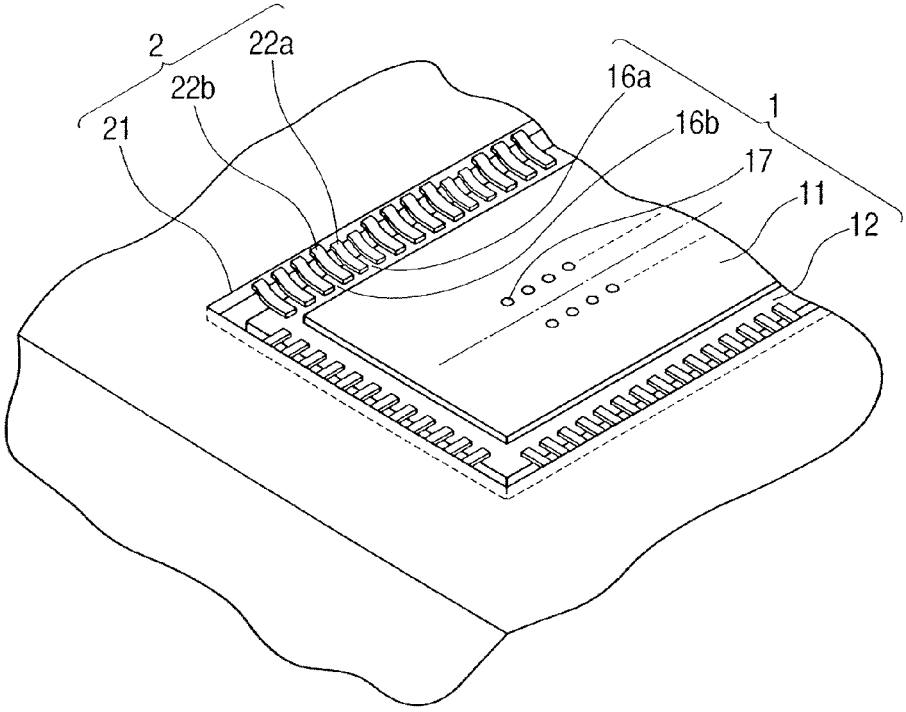
FIG. 6 is a schematic oblique view for explaining a connecting state of the recording element and the flexible wiring substrate of the second embodiment.

FIG. 6 is an oblique view showing a connecting state of the recording element substrate 1 and the flexible wiring substrate 2', and shows a state thereof before being covered by a sealing compound 3 (see FIG. 1).

Figure 7:
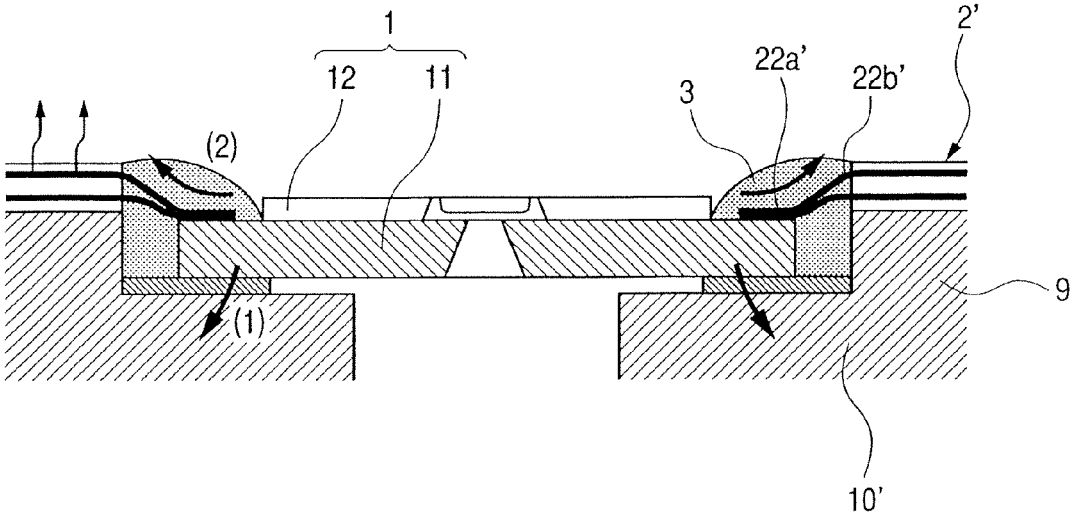
FIG. 7 is a schematic sectional view of the second embodiment.

FIG. 7 is a sectional view schematically showing a connecting state of the recording element substrate 1 and the flexible wiring substrate 2'.

The recording element substrate 1 is adhered to a container 9 by an adhesive 10' of epoxy resin. With regard to heat dissipation of the present embodiment, similarly to the description of the first embodiment, by passing through a path (2), the heat immediately travels through the entire surface of the flexible wiring substrate 2', and is effectively released into the atmosphere (ambient air) through the base material 24*a*.

In the present embodiment also, it is preferable that the wiring sheet 25*b'* forms the wiring across its entire surface (makes its entire surface into a conductive region). As shown in FIG. 5A, the conductive region (wiring pattern) in the wiring sheet 25*a'* is small comparing to the wiring sheet 25*b'*, and when the wiring is formed across the entire surface of the wiring sheet 25*b'*, the conductive region of the wiring sheet 25*b'* becomes by far large, and the heat traveling through the path (2) becomes dominant.

Third Embodiment

Next, a third embodiment of the present invention will be described.

Figure 8:
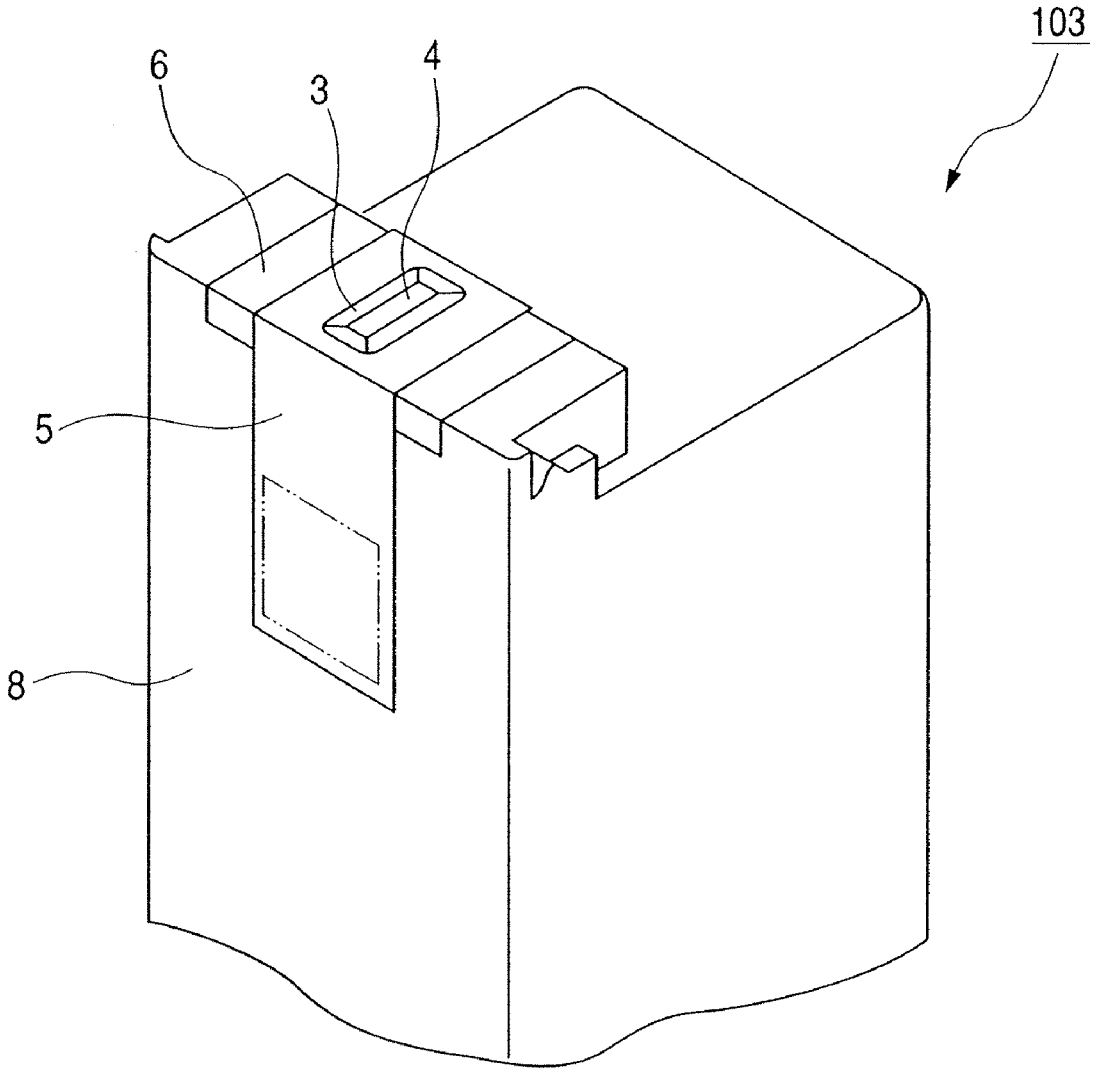
FIG. 8 is a schematic oblique view of an ink jet recording head as a third embodiment according to the present invention.

FIG. 8 is a view showing an ink jet recording head 103 of the third embodiment of the present invention. What the present embodiment differs from the first embodiment is that, while, in the first embodiment, as shown in FIG. 1, a recording element substrate 1 and a flexible wiring substrate 2 are fixed to a container 9 which is a support member through an adhesive, in the present embodiment, a recording element substrate 4 and a flexible wiring substrate 5 are fixed to a container 8 through a support member 6.

Figure 9:
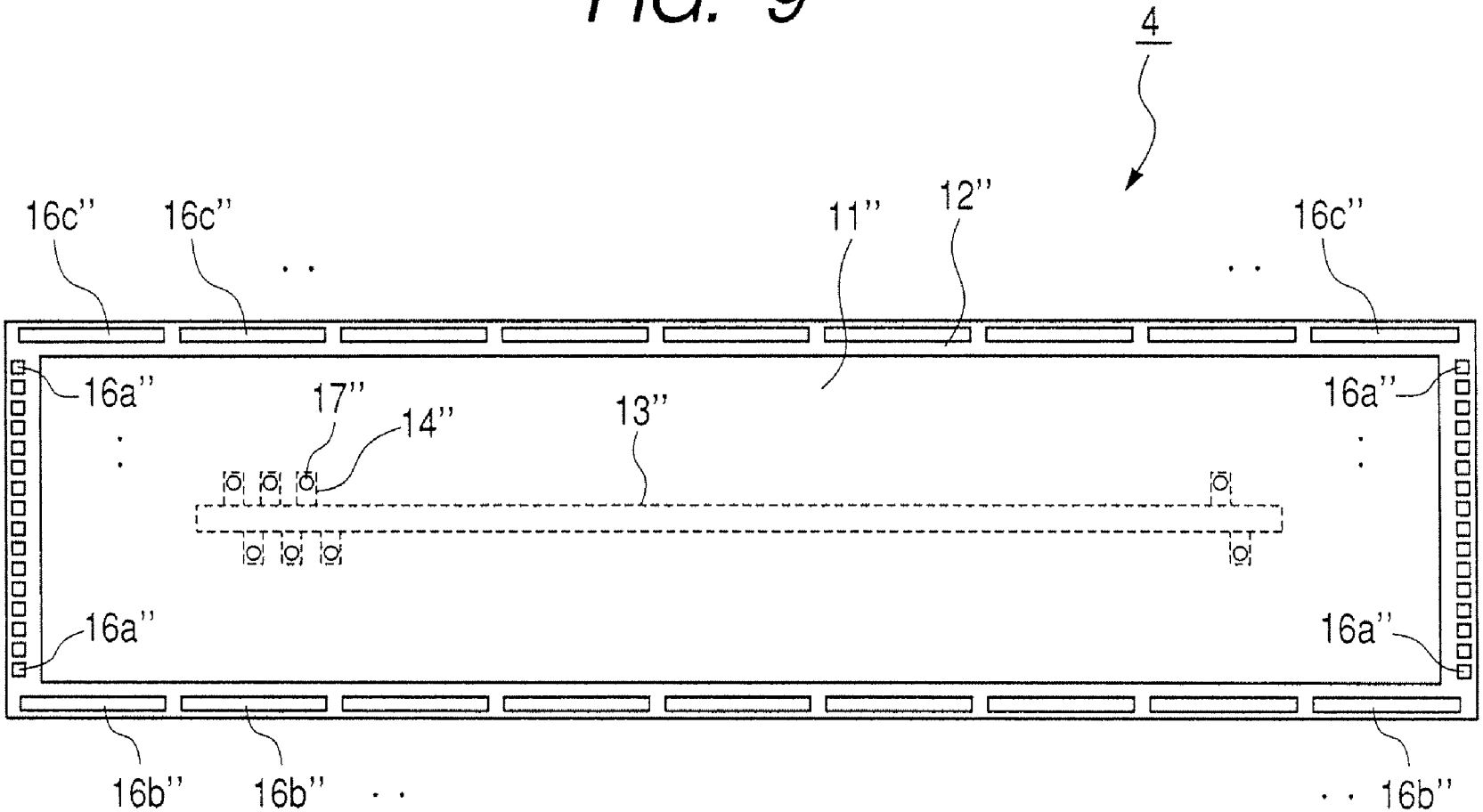
FIG. 9 is a schematic explanatory drawing of the recording element of the third embodiment.

FIG. 9 is a top view showing a schematic structure of the recording element substrate 4 of the third embodiment of the present invention.

The recording element substrate 4 is composed of a two layer structure comprising an orifice plate 11" and a substrate 12", and forms a plurality of ink paths 14". The orifice plate 11" is provided with ink discharge ports 17" corresponding to each ink path 14", and these ink discharge ports 17" have 300 dpi per one column, and two columns thereof are arranged. The substrate 12" has a size of a width of 4.8 mm×a length of 17 mm×a width of 0.625 mm, and in the center thereof, there are provided supply ports 13" for supplying ink to each ink path 14" and an electrothermal conversion elements (not shown) corresponding to each ink path 14", and moreover, a plurality of electrodes 16*a*" used for the supply of electrical signals such as recording signals and the like to the outer periphery, and a plurality of electrodes 16*b*" and 16*c*" not used for the supply of electrical signals. The plurality of electrodes 16*a*" are square shaped, and for inputting the electrical signals such as the recording signals and the like from the ink jet recording apparatus main body, and the plurality of 16*b*" and 16*c*" are rectangle shaped and connected to the base layer of the substrate 12", but not for receiving the recording signals. These electrodes 16*a*", 16*b*" and 16*c*" are formed by using a plating patterning technique.

What the recording element substrate 4 differs from the recording element substrate 1 in the first and second embodiments shown in FIGS. 2A and 2B is that, in the first and second embodiments, the electrodes 16*b* alone are arranged in the opposing short sides and, in the long sides, two electrodes 16*a* are arranged regularly and moreover at equal intervals in such a way as to be arranged between electrodes 16*b*, while, in the present embodiment, a plurality of electrodes 16*a*" for inputting the electrical signals such as the recording signals and the like from the ink jet recording apparatus main body side are arranged in a row on the short sides of the outer periphery of the recording element substrate 4, and the electrodes 16*b*" and 16*c*" not for inputting the electrical signals are arranged on the long sides of the outer periphery, and are connected to the aluminum wiring layer of a power source GND of the substrate 12". Further, the plurality of electrodes 16*b*" are connected to the aluminum wiring layer of the one power source GND of the substrate 12", and the plurality of electrodes 16*c*" are connected to the aluminum wiring layer of the other power source GND of the substrate 12".

Figure 10A:
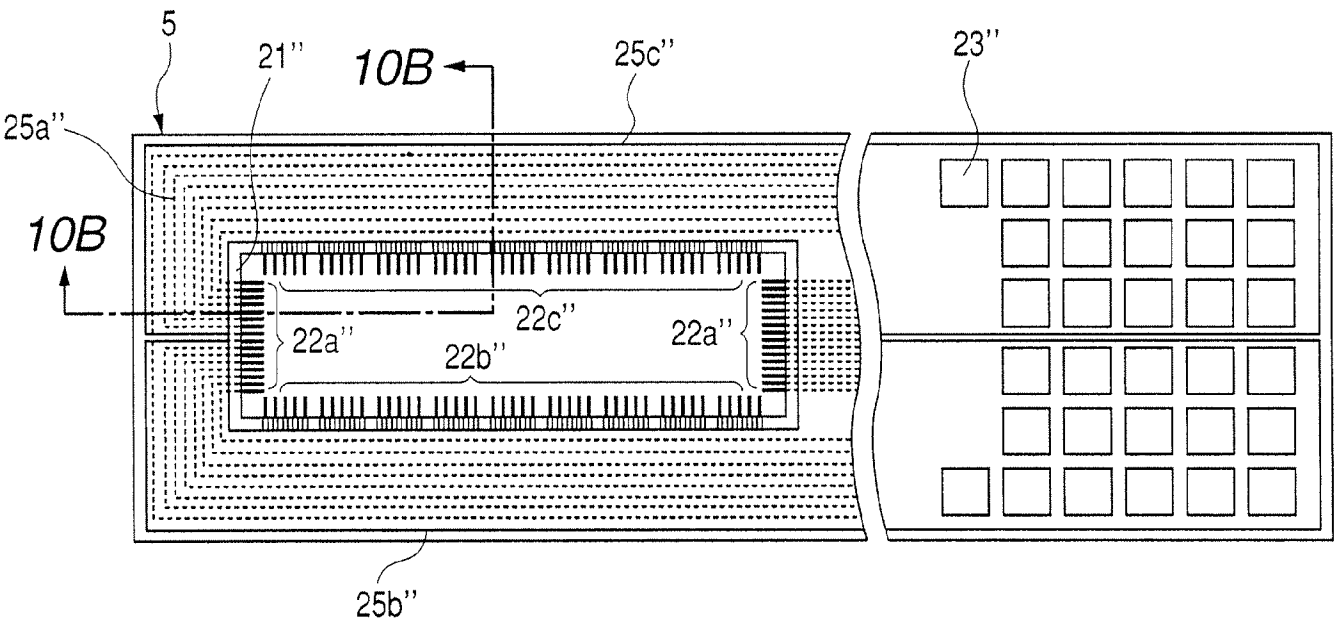
FIGS. 10A and 10B are schematic explanatory drawings of the flexible wiring substrate of the third embodiment.
Figure 10B:
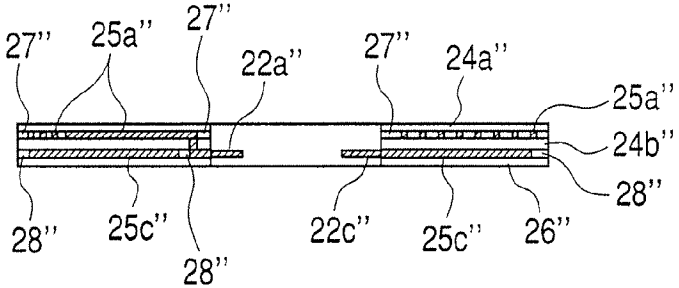

FIGS. 10A and 10B are a top view and a sectional view showing a schematic structure of a flexible wiring substrate 5, and FIG. 10B is a sectional view cut along a line 10B-10B of FIG. 10A.

An opening 21" is provided to be able to see the recording element substrate 4 when the flexible wiring substrate 5 is attached to the support member 6 together with the recording element substrate 4 (see FIG. 8), and in the inner periphery of the opening 21", there are provided a plurality of terminals 22*a*" coupled with a plurality of electrodes 16*a*", and a plurality of terminals 22*b*" coupled with a plurality of electrodes 16*b*" and a plurality of terminals 22*c*" coupled with a plurality of electrodes 16*c*". A plurality of electrode pads 23 correspond to the plurality of electrode terminals 22*a*", and play a role of receiving the electrical signals from the ink jet recording apparatus main body, and transferring them to the recording element substrate 4.

As shown in FIG. 10B, the flexible wiring substrate 5 is constituted by comprising the wiring sheets which are arranged so as to be superposed on each other in two layers, and between a base material 24*a*" and a base material 24*b*", there is formed a space for providing a first wiring sheet 25*a*". Between the base material 24*b*" and the protective material 26", there is formed a space for providing second wiring sheets 25*b*" and 25*c*", and moreover, in that space, there are provided a plurality of terminals 22*b*" and 22*c*" connected to the wiring sheet 25*b*" and 25*c*", and also a connecting portion neighborhood portion with the terminal 22*a*" and the wiring sheet 25*a*" used for executing the recording. An adhesive 28" for adhering the base material 24*b*" and the protective material 26" fills up that space. Here, the plurality of terminals 22*a*" are connected to the wiring sheets 25*a*". Further, the wiring sheet 25*b*" is connected to the one side power source GND line from among the wiring sheets 25*a*" inside the flexible substrate 5, and the wiring sheets 25*c*" are electrically connected to the other side power source GND line from among the wiring sheets 25*a*" inside the flexible substrate 5.

Figure 11:
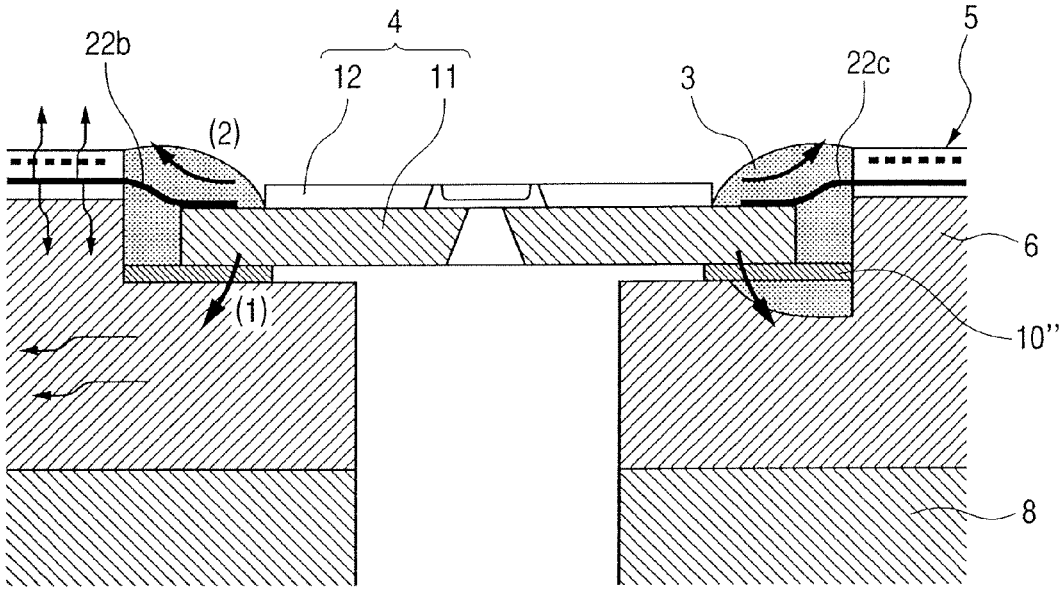
FIG. 11 is a schematic sectional view of the third embodiment.

FIG. 11 is a sectional view schematically showing a connecting state of the recording element substrate 4 and the flexible wiring substrate 5. Parts of the recording element substrate 4 and the flexible wiring substrate 5 are adhered to the support member 6 by an adhesive 10" of epoxy resin, and this support member 6 is fixed to the container 8.

With regard to heat dissipation of the present embodiment, what the present embodiment differs from the first and second embodiments is that the support member 6 is made of alumina, and the heat conductivity of this alumina is approximately 20 W/mK and is relatively large, which allows heat dissipation and heat reserve to operate. The heat which travels to the support member 6 from the rear surface of the recording element substrate 4 through the adhesive 10" spreads across the entire support member 6, and immediately at the same time, the heat which travels to the wiring sheet 25*b*" and 25*c*" of the flexible wiring substrate 5 through a plurality of electrodes 16*b* and 16*c* travels also to the support member 6, and moreover at the same time, is released into the atmosphere (ambient air) from the surface of the flexible wiring substrate 5. As a result, the heat dissipation property of the recording element substrate 4 is extremely enhanced.

Further, a plurality of electrodes 16*b*" and 16*c*" which have a high level of heat dissipation operation are arranged in a row on the other long sides of the outer periphery of the recording element substrate 4. Hence, the heat scarcely travels to the plurality of electrodes 16*a*" for inputting the electrical signals such as the recording signals from the ink jet recording apparatus main body, and signal transmission deficiency due to heat factor is hard to be generated.

In the present embodiment also, it is preferable that the wiring sheet 25*b*" and the wiring sheet 25*c*" form the wiring in its entire surface (make the entire surface into a conductive region). As shown in FIG. 10A, the conductive region (wiring pattern) in the wiring sheet 25*a*" is small comparing to a area joining together the wiring sheet 25*b*" and the wiring sheet 25*c*", and when the wiring is formed across the entire surfaces of the wiring sheet 25*b*" and the wiring sheet 25*c*", the conductive regions of the wiring sheet 25*b*" and the wiring sheet 25*c*" become by far large, and the heat traveling through these sheets becomes dominant.

Fourth Embodiment

Next, a fourth embodiment of the present invention will be described.

Figure 12:
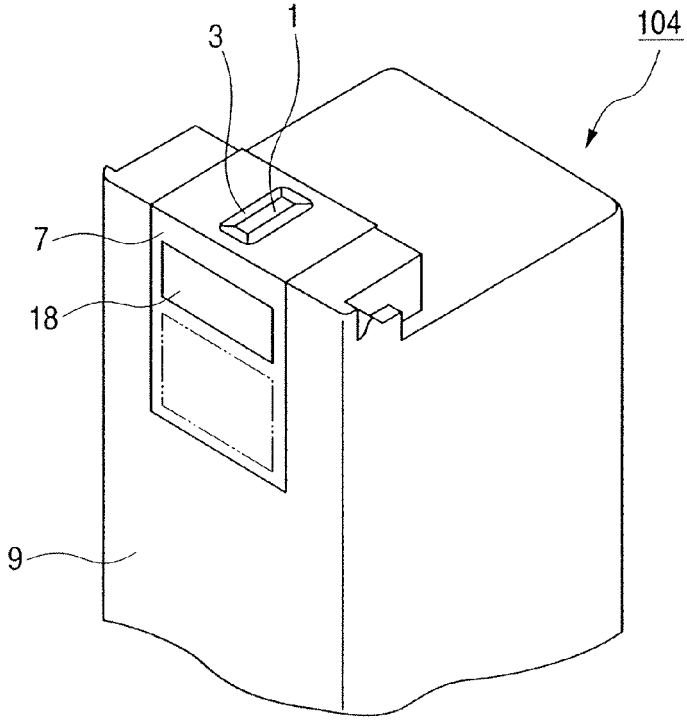
FIG. 12 is a schematic oblique view of an ink jet recording head as a fourth embodiment according to the present invention.

FIG. 12 is a view showing an ink jet recording head 104 of a fourth embodiment of the present invention. In the present embodiment, similarly to the first embodiment shown in FIG. 1, though a recording element substrate 1 and a flexible wiring substrate 7 are fixed to a container 9 which is a support member through an adhesive, the embodiment is different from the first embodiment in that a heat dissipation pad 18 is provided on the flexible wiring substrate 7.

Figure 13:
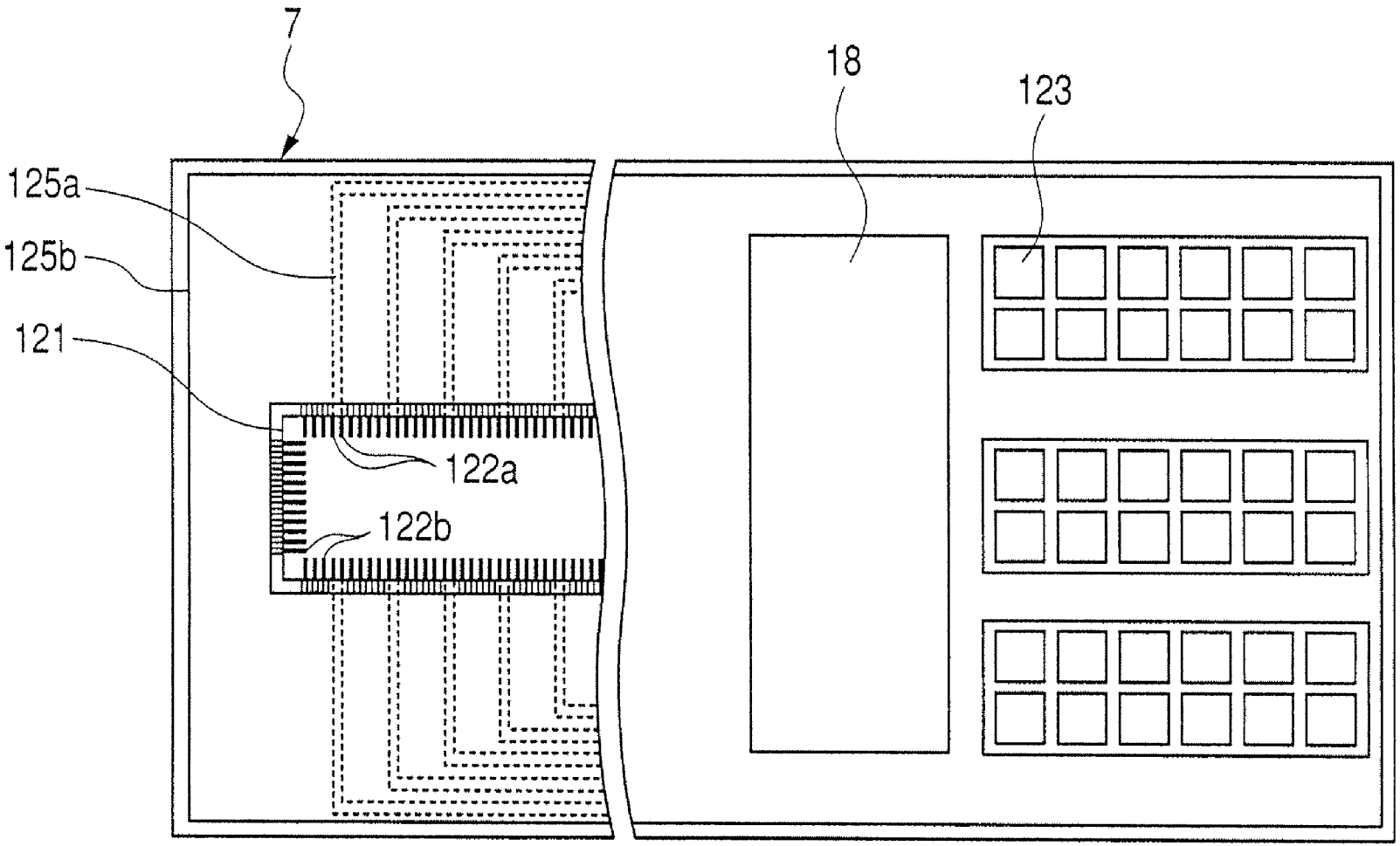
FIG. 13 is a schematic explanatory drawing of the flexible wiring substrate of the fourth embodiment.

FIG. 13 is a top view showing a schematic structure of the flexible wiring substrate 7. In the drawing, an opening 121, terminals 122*a* and 122*b*, an electrode pad 123, a wiring sheet 125*a* and a wiring sheet 125*b* are the same as the opening 21, the terminals 22*a* and 22*b*, the electrode pad 23, the wiring sheet 25*a* and the wiring sheet 25*b* shown in FIG. 3. A heat dissipation pad 18 has a part of the wiring sheet 125*b* exposed and the surface thereof subjected to gold plating.

The heat dissipation pad 18 is allowed to directly contact heat dissipating means of an ink jet recording apparatus side when mounted on the ink jet recording apparatus, and is capable of performing further heat dissipation by being directly brew by wind of a motor fan provided in the ink jet recording apparatus side.

This application claims priority from Japanese Patent Application No. 2003-404514 filed Dec. 3, 2003, which is hereby incorporated by reference herein.

What is claimed is:

1. A liquid discharging head comprising:

a rectangular recording element substrate having, on a main surface thereof, electrothermal transducers for generating thermal energy used for discharging a liquid, first electrodes for supplying electrical signals to the electrothermal transducers and second electrodes not used for supplying electrical signals to the electrothermal transducers; and a wiring sheet having an opening through which the recording element substrate is exposed, the wiring sheet being provided with a first wiring pattern connected to the first electrodes and a second wiring pattern connected to the second electrodes, wherein a plurality of the first electrodes are formed along a first side of the recording element substrate having a predetermined length and a plurality of the second electrodes are formed along a second side of the recording element substrate, the second side being longer than the first side and extending in a direction transverse to the first side.

2. A liquid discharging head according to claim 1, wherein each of the second electrodes is longer than the first electrodes.

* * * * *